United States Patent [19]

Aslizadeh

[11] Patent Number: 4,605,270

[45] Date of Patent: Aug. 12, 1986

[54] COVER FOR ELECTRICAL OUTLET

[76] Inventor: Nejdeh Aslizadeh, 1050 Mont Royal Blvd., North Vancouver, B.C., Canada

[21] Appl. No.: 693,291

[22] Filed: Jan. 22, 1985

[51] Int. Cl.[4] ..... H01R 13/447

[52] U.S. Cl. ..... 339/40; 339/42; 339/36

[58] Field of Search ..... 339/36, 40, 42

[56] References Cited

U.S. PATENT DOCUMENTS

| | | | |
|---|---|---|---|
| 2,516,464 | 7/1950 | Hooser | 174/67 |
| 3,865,456 | 2/1975 | Dola | 339/40 |
| 4,279,457 | 7/1981 | Nickence | 339/36 |
| 4,302,624 | 11/1981 | Newman | 339/36 |
| 4,549,778 | 10/1985 | Price et al. | 339/40 |

*Primary Examiner*—Gil Weidenfeld
*Assistant Examiner*—Paula A. Austin
*Attorney, Agent, or Firm*—T. R. Zegree

[57] ABSTRACT

An improved protective cover for an electrical outlet comprises a pair of slidable closure plates and a pair of coil spring-actuated blocking plates, both types of plates being positioned within the boundaries of rectangular openings in the front wall of the cover.

12 Claims, 6 Drawing Figures

COVER FOR ELECTRICAL OUTLET

BACKGROUND OF THE INVENTION

This invention relates to an improved cover for an electrical outlet. More particularly, the invention relates to a protective cover for an elctrical outlet designed specifically to prevent access to such outlet when an electric plug is not inserted therein.

Various types of protective plates for exposed electrical outlets have been described in the patent literature. For example, U.S. Pat. No. 2,516,464 to Hooser shows a safety shield for electric outlets provided with raised slide bars having notches cut in their outer edges and latches for cooperation therewith. U.S. Pat. No. 3,865,456 to Dola discloses a cover plate for an electrical receptacle comprising a wire spring biasing mechanism for shutters to assist return of the shutters to their normal position. U.S. Pat. No. 4,279,457 to Nickense describes a cover plate which is slidably attached to an electrical connector by means of a tab extending from the cover plate into a slot in the connector. U.S. Pat. No. 4,302,624 to Newman covers an electric wall outlet protector mountable on the existing outlet plate which includes doors swingable against a return spring bias to an open position. While these prior patents teach the broad concept of protective plates of various structural forms for electrical outlets, the device of this invention provides a new approach to the structure of cover plates which has certain advantages over the prior devices.

OBJECTS OF THE INVENTION

In view of the foregoing, it is the principal object of the present invention to provide an improved cover for standard electrical outlets having two pairs of slots for insertion of electrical plugs.

Another object of the invention is the provision of a safety device for mounting on a wall to cover an electrical outlet, thereby preventing accidental electric shock caused through inadvertent insertion of a wire or a similar metallic object into a slot of the outlet.

A further object of the invention is to provide a novel cover of substantially the same size as the conventional cover plates for electrical outlets which can be easily affixed to a wall in which an electric outlet is situated.

A still further object of the invention is to provide a safe, removable protective cover for an electric outlet which can be easily manufactured at a low cost in volume quantities from commercially available materials.

BRIEF SUMMARY OF THE INVENTION

These and other objects of the present invention will become more fully apparent from the following description taken in conjunction with the accompanying drawing.

In accordance with the invention, there is provided a cover for an electrical outlet having a pair of receptacles adapted to receive prongs of an electrical plug. The improved cover comprises, in combination, a pair of spaced apart rectangular openings in the front wall of said cover; a protective closure plate mounted within each of said openings for slidable, upward or downward movement; and a spring actuated blocking plate movable rearwardly or frontwardly upon manual depression thereof in each of said openings. The closure plate is positioned in the same plane as said front wall and said blocking plate so that said receptacles are securely covered when said cover is in closed position. Said closure plate overlies said blocking plate when slidably moved to open position whereby said receptacles are exposed for insertion of said prongs therein.

BRIEF DESCRIPTION OF THE DRAWING

The invention will now be more fully described with reference to the accompanying drawing wherein.

DETAILED DESCRIPTION OF THE INVENTION

Figure 1:
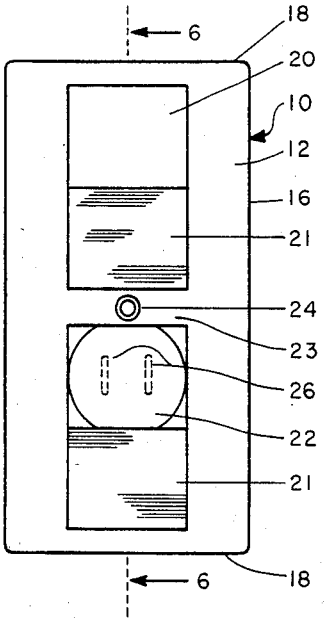
FIG. 1 is a front view of the cover according to the invention.
Figure 2:
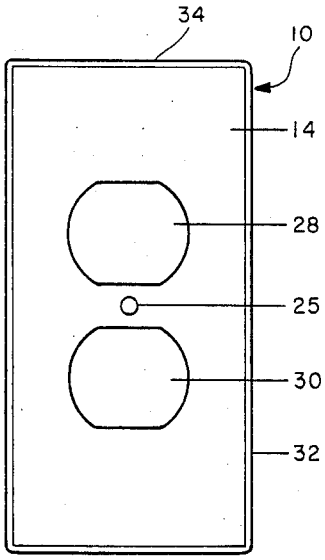
FIG. 2 is a rear view of the cover shown in FIG. 1.

Referring now to the drawing wherein like reference characters designate corresponding elements, a protective cover 10 for electrical wall outlet, as illustrated in FIGS. 1 and 2, comprises a rectangular unitary housing having a flat front wall 12, an opposite flat rear wall 14, a pair of laterally opposing narrow side walls 16 and a pair of opposing end walls 18, thereby forming closed outer boundaries. A pair of substantially the same size symmetrical rectangular openings 22 is provided in front wall 12, the openings 22 being spaced apart by a central lateral portion 23 of front wall 12 having a centrally disposed hole 24 registering with a hole 25 in rear wall 14 thereby forming a passageway for a screw 42 adapted for affixing cover 10 to a flat wall surface in upright position.

A pair of flat, slidable closure plates 21 is mounted within the openings 22 adjacent a pair of flat, coil spring-actuated blocking plates 20 of dimensions substantially equal to those of closure plates 21, both blocking plates 20 being likewise positioned within the openings 22. Both plates 20 and 21 are disposed contiguously in the same plane forming a common upper surface with front wall 12 when cover 10 is in closed position. Blocking plates 20 are positioned under slidable closure plates 21 in parallel planes with the entire rear surface of plate 21 touching the entire surface of plate 20 when cover 10 is in open position. A pair of spaced apart openings 28 and 30 in rear wall 14 of substantially the same size and having a pair of opposed semi-circular side portions is located adjacent central lateral portion thereof in registry with openings 22 in front wall 12 when cover 10 is in open position to permit insertion of prongs of an electrical plug therethrough into standard slots of an electrical outlet provided in a wall.

Figure 4:
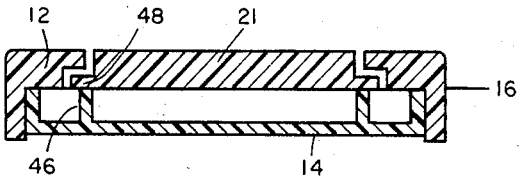
FIG. 4 is an enlarged detailed cross-sectional view of the closure plate positioned between the front and rear walls of the cover.
Figure 5:
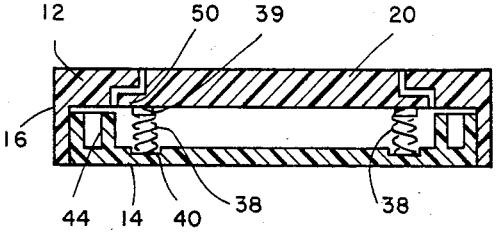
FIG. 5 is an enlarged detailed cross-sectional view of the blocking plate positioned between the front and rear walls of the cover in its closed position.

The slidably movable closure plates 21 comprise a short lateral flange 48 shown in FIG. 4 on each side thereof projecting towards the outer perimeter of front wall 12. The rear side of front wall 12 comprises a recess (not shown) extending longitudinally along the vertical portions thereof adjacent each side of rectangular openings 22 between lateral portion 23 and their distal ends for slidable engagement of lateral flanges 48 in closure plates 21. Likewise, blocking plates 20 include substantially identical lateral flanges 50, as shown in FIG. 5, so that both plates 20 and 21 have substantially the same configuration.

Figure 6:
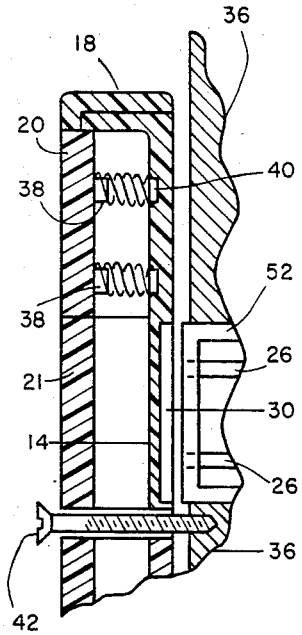
FIG. 6 is an enlarged, fragmentary side view taken along the lines 6—6 of FIG. 1 showing the cover secured to a wall in closed position in which the blocking plate with coil springs is positioned in the upper portion of the rectangular opening and the closure plate is positioned in the lower portion of the same opening thereby covering a schematically illustrated electrical outlet.

To permit a slidable upward or downward movement of closure plate 21 in the same plane as front wall 18 within the confines of rectangular openings 22 along their vertical edges, each blocking plate is provided with a plurality of small compressive coil springs 38, preferably four, which are affixed to rear wall thereof in spaced apart relationship by mounting them on short cylindrical projections 39 in the rear surface of plates 20, the outside diameter of which is only slightly smaller than the inner diameter of the springs to assure a substantially tight fit therebetween. The free ends of springs 38 are positioned in shallow round recesses 40, as illustrated in FIGS. 5 and 6, formed in the inner surface of rear wall 14 to assure that springs 38 are compressed in a direction perpendicular to the surface of the rear wall 14. In this way, the rearward movement of the closure plate actuated by compression of coil springs 38 enhances the frictional engagement between the inner surface of closure plate 21 and outer surface of blocking plate 20 when closure plate 21 is slidably moved in either direction to a locking open or closed position, the two positions being illustrated in FIG. 1 in which both plates 20 and 21 of the same dimensions fill completely the upper rectangular opening 22 when cover 10 is in closed position and plate 21 overlies plate 20 when cover 10 is in open position.

Figure 3:
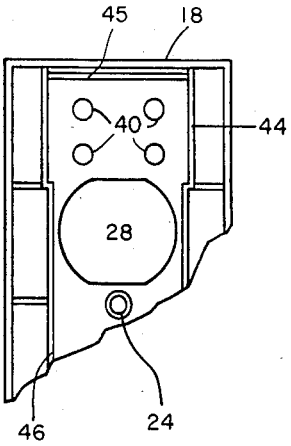
FIG. 3 is a fragmentary view of the inner surface of the cover's rear wall.

As shown in FIG. 3, the inner surface of rear wall 14 is provided with a plurality of ledges which function as guides for both plates 20 and 21. Thus vertically disposed ledges 44 and transverse ledges 45 permit to maintain blocking plates 21 in fixed position when springs 38 are compressed and closure plate 21 overlies blocking plate 20. The vertical ledges 46 function as support for narrow lateral flanges 48 of closure plates 21 when cover 10 is in closed position. It will be noted that all the ledges are positioned at a substantially right angle to the inner surface of rear wall 14.

The assemblage of the various components of cover 10 may be conveniently effectuated by placing blocking plates 20 and closing plates 21 in their respective locations on the inner surface of rear wall 14, then affixing front wall thereto by first applying a suitable adhesive along the inner surface of edges 32 of side walls 16 and edges 34 of end walls 18 and placing the front wall 12 in engagement with rear wall 14 so that the outer surface of rear wall 14 is substantially flush with the entire perimeter of edges 32 and 34.

As illustrated in FIG. 6, cover 10 is secured directly in an upright position by means of a screw 42 to a vertical wall 36 in which is fitted an electrical outlet 36. Cover 10 is shown in closed position preventing access to slots 26 or to an aperture for a grounding pin (not shown) by any undesirable objects. When closure plate 21 is moved to an open position, rectangular openings 22 and openings 28, 30 in rear wall 14 are in substantial registry with the opening in wall 36 so that an electrical plug can be easily inserted into the outlet.

The cover of this invention is of substantially the same size as standard cover plates for electrical outlets so that an existing standard plate can readily and quickly be removed from the wall and replaced by a cover of the invention using a single screw of a suitable length which is turned by means of a screwdriver. Cover 10 can be fabricated from a plastic material by any of the well known molding procedures to produce a durable product which is rigid and impact-resistant.

It will be apparent from the foregoing description that I have devised an improved stationary cover of simple construction which is useful in protecting hot electrical outlets from being inadvertently contacted by a metallic object other than prongs of an electrical plug. The cover is characterized by a new combination of elements which are required for its basic function. The slidable closure plates which do not include and tabs or biasing mechanisms for their manipulation are easily movable manually to an open position exposing the slots of an electrical outlet and likewise returned to a closed position when the outlet is not in use so that such slots can not be contacted or seen. In addition, when not in use, the closed protective cover prevents heat loss through openings in standard cover plates mounted on walls of a house or an office building or any other place connected to electricity. The cover of the invention may be used in conjunction with electrical outlets having standard slots as well as those having circular tubular openings for receiving prongs and grounding pins projecting from electrical plugs.

It will be understood that various modifications in the form of this invention as herein described in its preferred embodiment may be made without departing from the spirit thereof or the scope of the claims which follow.

I claim:

1. In a cover for an electrical outlet having a pair of receptacles adapted to receive prongs of an electrical plug, the improvement comprising in combination:

a pair of spaced apart rectangular openings in front wall of said cover;

a protective closure plate mounted within each of said openings for slidable upward and downward movement;

a spring-actuated blocking plate movable rearwardly or frontwardly within each of said openings, said blocking plate being provided with a plurality of coil springs affixed to rear wall thereof and positioned in contact with inner surface of rear wall of said cover;

said closure plate being positioned in the same plane as said front wall and said blocking plate whereby said receptacles are covered when said cover is in closed position and said closure plate is overlying said blocking plate when slidably moved to open position to expose said receptacles to insertion of said prongs therein.

2. The cover of claim 1 wherein movement of said blocking plate is actuated by the sliding movement of said closure plate.

3. The cover of claim 1 wherein said rectangular openings are of substantially the same size.

4. The cover of claim 1 wherein each of said coil springs is mounted on a cylindrical projection in said rear wall.

5. The cover of claim 1 wherein said closure plate is slidably movable in the same plane as the front wall of said cover.

6. The cover of claim 1 wherein said closure plate and said blocking plate are of substantially the same dimensions and fill completely each of said rectangular openings in the front wall of said cover when in closed position.

7. The cover of claim 1 wherein said closure plate is unbiased and in frictional engagement with said blocking plate during upward or downward sliding movement thereof.

8. The cover of claim 1 wherein said rectangular openings are separated from each other by central lateral portion of said front wall.

9. The cover of claim 8 wherein said lateral portion comprises a centrally disposed hole adapted for passage of a screw therethrough.

10. The cover of claim 1 wherein said closure plate comprises a lateral flange on each side thereof projecting towards the outer perimeter of said front wall.

11. The cover of claim 10 wherein the rear side of said front wall comprises a recess extending along the vertical portions thereof adjacent each side of said rectangular openings for slidable engagement of said lateral flange therein.

12. A protective cover for electrical wall outlet comprising:

a unitary rectangular housing having a flat front wall, an opposite flat rear wall, a pair of laterally opposing narrow side walls and a pair of opposing end walls thereby forming closed outer boundaries;

a pair of rectangular openings in said front wall of substantially the same size, said openings being spaced apart by a central lateral portion of said front wall;

a centrally disposed hole in said lateral portion of said front wall registering with a hole in said rear wall forming a passageway for a screw;

a pair of flat, slidable closure plates, each of said closure plates being mounted within each of said openings;

a pair of flat coil spring-actuated blocking plates of dimensions substantially equal to said closure plates, each of said blocking plates being positioned within each of said openings;

said closure plates, said blocking plates and said front wall being disposed in the same plane when said cover is in closed position and said blocking plates being positioned under said closure plates in parallel planes when said cover is in open position; and a pair of spaced apart openings in said rear wall of substantially the same size, said openings in said rear wall being located adjacent central lateral portion of said rear wall in registry with said openings in said front wall when said cover is in open position to permit insertion of prongs of an electrical plug into said wall outlet.

* * * * *